US005817264A

United States Patent [19]

Hsieh

[11] Patent Number: 5,817,264

[45] Date of Patent: Oct. 6, 1998

[54] THERMAL TRANSFER COMPOSITION AND PROCESSES THEREOF

[75] Inventor: Bing R. Hsieh, Webster, N.Y.

[73] Assignee: Xerox Corporation, Stamford, Conn.

[21] Appl. No.: 843,372

[22] Filed: Apr. 15, 1997

[51] Int. Cl.[6] ..... B28B 11/00

[52] U.S. Cl. ..... 264/131; 427/384; 430/45; 430/57; 430/78; 430/134; 430/135; 264/233

[58] Field of Search ..... 430/135, 57, 56, 430/58, 78, 59, 83, 291, 126, 134, 45; 282/27.5; 264/131, 233; 427/384

[56] References Cited

U.S. PATENT DOCUMENTS

| | | | |
|---|---|---|---|
| 4,456,669 | 6/1984 | Yubakami et al. | 430/45 |
| 4,882,254 | 11/1989 | Loutfy et al. | 430/59 |
| 4,945,156 | 7/1990 | Jenekhe et al. | 528/485 |
| 4,963,616 | 10/1990 | Jenekhe | 526/600 |
| 5,238,766 | 8/1993 | Molaire et al. | 430/78 |
| 5,334,478 | 8/1994 | Desilets et al. | 430/135 |
| 5,405,724 | 4/1995 | Hsieh et al. | 430/57 |
| 5,449,582 | 9/1995 | Hsieh et al. | 430/134 |

*Primary Examiner*—Merrick Dixon
*Attorney, Agent, or Firm*—John L. Haack

[57] ABSTRACT

A process for the preparation of a thermal diffusion transfer component comprising: dissolving an organic pigment in a Lewis acid and a polar aprotic solvent to form a pigment solution; coating the solution on a substrate; optionally washing the coated substrate with a protic solvent to remove the Lewis acid and the aprotic solvent; and optionally drying the coated substrate.

16 Claims, No Drawings

THERMAL TRANSFER COMPOSITION AND PROCESSES THEREOF

REFERENCE TO COPENDING AND ISSUED PATENTS

Attention is directed to commonly owned and assigned U.S. Pat. No. 5,449,582, issued Sep. 12, 1995, entitled "PROCESSES FOR PIGMENT DISPERSION AND ARTICLES THEREFROM," and U.S. Pat. No. 5,405,724, issued Apr. 11, 1995, entitled "PHOTOCONDUCTIVE IMAGING MEMBERS AND PROCESSES THEREOF COMPRISING SOLUBILIZED PIGMENT-LEWIS ACID COMPLEXES."

Attention is directed to commonly owned and assigned, copending application U.S. Ser. No. 08/(not yet assigned) (D/95334), filed concurrently herewith (not yet assigned), entitled "INK COMPOSITION HAVING PIGMENT NANOPARTICLES AND A PROCESS FOR THE PREPARATION THEREOF", wherein there is disclosed ink compositions containing nanometer scale pigment particles that are produced by preparing a pigment solution including a solubilized pigment-Lewis acid complex and a polar aprotic solvent system, mixing a precipitating solution with the pigment solution to precipitate pigment nanoparticles, and formulating the pigment nanoparticles with a formulating solvent. The ink jet compositions are particularly suitable for use as ink jet inks.

The disclosures of each the above mentioned patents and copending applications are incorporated herein by reference in their entirety.

BACKGROUND OF THE INVENTION

The present invention is generally directed to thermal transfer printing compositions and processes for the preparation and use thereof. More specifically, the present invention relates to thermal diffusion transfer compositions comprising molecularly dispersed or nanoscopically dispersed pigment particles for use in thermal transfer printing media and printing processes thereof. The thermal transfer printing compositions and processes thereof of the present invention, in embodiments, provide improved color, excellent water fastness, and acceptable light fastness properties to the resulting images formed by thermal diffusion transfer processes. The preparative processes, in embodiments, can be used to formulate, for example, thermal transfer ribbons that contain nanoscopically dispersed pigment particles which when transferred to a suitable substrate and thermally transferred to a second substrate, produce images which are very robust with respect to environmental agents, such as air, light, water, and the like, and more robust as compared to conventional dye based thermal transfer marking materials. In other embodiments, the preparative processes of the present invention include coating the nanoscopically dispersed pigment particles upon suitable carrier particles, for example a polymeric resin, to produce a stable dispersion of pigmented carrier particles that can be coated onto a suitable "transfer" substrate by conventional means to produce thermal transfers ribbons with the aforementioned improved properties. The compositions and processes of the present invention are also applicable to the fabrication of photographic films with the aforementioned improved properties, for example, coating nanoscopically dispersed pigment particles upon suitable carrier particles which provide the colorants in black and white, and color photography.

Other advantages afforded by processes of the present invention, and believed to arise from the nanoparticle pigment dispersions generated thereby, include high color strength, high color fidelity and line resolution, and a high degree of transparency and projection efficiency, of the thermally transferred images.

PRIOR ART

In the aforementioned commonly owned and assigned U.S. Pat. No. 5,449,582, there is disclosed a process for preparing ultrafine pigment dispersions comprising providing a solubilized mixture of pigment-Lewis acid complex and an aprotic organic solvent; precipitating the resulting solubilized complex into a protic solvent thereby forming a dispersion of ultrafine pigment particles; removing the aprotic and protic solvents to afford a wet cake containing finely divided pigment particles; optionally neutralizing and washing the wet cake particles; and redispersing the resulting ultrafine pigment particles in an aqueous solution, an organic solvent, or mixtures thereof, and a binder resin to form an ultrafine pigment and binder resin dispersion.

In the aforementioned commonly owned and assigned U.S. Pat. No. 5,405,724, there is disclosed a process for forming thin films of pigment compounds comprising providing a solubilized pigment-Lewis acid complex contained in an aprotic organic solvent system and coating the solubilized pigment-Lewis acid complex containing solvent system on a substrate.

In U.S. Pat. No. 4,456,669, Jun. 26, 1984, to Yubakami et al., there is disclosed an image forming process utilizing heat-transferable dyes to form images on a receiving substrate. Image signals are used to arrange image forming particles on a support member. The particles contain a dye former which is heat-transferred onto an image receiving substrate. After heating, a color developing agent is used to adhere the dye former to the image receiving substrate.

The aforementioned patents are incorporated in their entirety by reference herein.

There continues to be a need for thermal transfer compositions and processes which provide for molecularly dispersed or nanoscopically dispersed pigment particles for use in thermal transfer printing media, and which media produces color images with improved color, water fastness, and light fastness properties, and high developability properties.

There also remains a need for thermal transfer compositions which are environmentally stable, compatible with a variety of other marking materials, supporting media, and printing substrates, such as coated and uncoated papers and transparency stock, and are easily prepared and processed using conventional methodology. There also remains a need for thermal transfer compositions that are suitable for use in high speed thermal transfer printing systems.

Also, there has been sought an inexpensive, efficient and environmentally efficacious means for producing thermal diffusion transfer compositions and printed images therefrom which are highly colorfast and light fast, and which compositions and images are essentially insoluble in common liquids, such as water and organic solvents, to improve water fastness properties, and to improve documentary permanence and informational integrity.

These needs and others solutions to the aforementioned problems are provided for in embodiments of the present invention and as illustrated herein.

SUMMARY OF THE INVENTION

Embodiments of the present invention, include:

overcoming deficiencies of prior art thermal diffusion transfer compositions by providing pigment based thermal transfer media and processes which have high operational and image environmental stability;

providing processes for the preparation of highly robust pigment based thermal transfer media;

providing a marking composition for use in thermal wax and thermal diffusion transfer printing comprising a substrate with a nanoscopically dispersed pigment layer coated thereon;

providing imaging processes for preparing high quality black and white and color images using the aforementioned highly robust thermal diffusion transfer compositions;

providing a process for the preparation of a thermal diffusion transfer composition comprising dissolving an organic pigment, and a Lewis acid, in a polar aprotic solvent to form a pigment solution; optionally adding a polymer binder or wax; coating the solution on a substrate; washing the coated substrate with a protic solvent to remove the Lewis acid; and optionally drying the coated substrate; and providing a method of imaging comprising providing a substrate; providing a thermal diffusion transfer composition comprising a substrate with a nanoscopically dispersed pigment layer coated thereon; and selectively heating, the thermal diffusion transfer composition in close proximity to a second substrate, wherein the nanoscopically dispersed pigment or pigments contained in the thermal transfer composition transfer to the second substrate so that a pigmented image is formed thereon.

Still other embodiments of the present invention include applying the aforementioned compositions and processes to laser thermal printing and related printing processes.

DETAILED DESCRIPTION OF THE INVENTION

The thermal transfer compositions and processes thereof of the present invention may be used to prepare a variety of thermal transfer media, including for example, thermal transfer ribbons for use with color printers.

An advantage of the present invention, in embodiments, is that the composition and processes thereof enable control over the color strength and quality, and stability properties of the resulting images.

In embodiments of the present invention there is provided a process for the preparation of a thermal diffusion transfer component comprising:

mixing, and preferably dissolving an organic pigment in a Lewis acid and a polar aprotic solvent, and optionally a polymeric binder, to form a pigment solution;

coating the solution on a carrier substrate thereby forming a thin film thereon;

washing the coated carrier substrate with a protic solvent to remove the Lewis acid; and optionally drying the coated carrier substrate.

In another embodiment of the present invention there is provided a process for the preparation of a thermal diffusion transfer composition comprising:

dissolving an organic pigment and a Lewis acid in a polar aprotic solvent to form a pigment solution;

coating the pigment solution onto a carrier substrate precoated with a binder layer;

washing the coated carrier substrate with a protic solvent to remove the Lewis acid; and optionally, but preferably drying the coated carrier substrate.

The preparation of the thermal transfer media, in embodiments, can further include adding colloidal particles to the pigment solution, wherein the pigments in the solution associate with the suspended colloidal particles upon coating onto a carrier substrate. The carrier substrate is, for example, of paper, plastic, metalized plastic, wood, metal, woven and non-woven fabric, glass, and mixtures thereof. Mixtures of substrates refer for example to composite structures, such as aluminized polyester films, and the like. The carrier substrate upon which the pigment dispersion is coated in forming the thermal transfer media can be, for example, an organic polymer, or a thermally conductive metal sheet. The carrier substrate can further include an adhesive layer, which is preferably precoated onto the substrate by the same or similar means used to apply the pigment dispersion. The carrier or supporting substrate has a thickness of from about 50 microns to about 1,000 microns, and preferably from about 60 microns to about 600 microns, and the dispersed pigment layer has a thickness of from about 0.01 microns to about 50 microns, and preferably from about to 0.1 to about 5.0 micron.

Various pigments are suitable for use in the present invention including metal phthalocyanines, metal-free phthalocyanines, oligo metal phthalocyanines, quinacridones, benzimidazole perylenes, perylene tetracarboxyl diimides, substituted 2,4-diamino-triazines, squarines, polynuclear aromatic quinones, azo pigments, thiopyrylium compounds, and the like, and mixtures thereof. Particularly preferred pigments are those which contain heterocyclic or alicyclic sulfur, nitrogen, or oxygen atoms which are capable of coordinating with the Lewis acid. Other suitable pigments for use in the present processes are disclosed, for example, in P. Gregory, "*High-Technology Applications of Organic Colorants*", Plenum Publishing Corp., 1991, New York, the disclosure of which is incorporated herein in its entirety.

The pigment concentration in the pigment solution is typically from about 0.005 to about 50, and preferably from about 0.01 to about 5 weight percent based on the total weight of the solution.

Polar aprotic solvent include but are not limited to alkylene halides, such as methylene chloride, chloroform, trichloroethane, 1,2-dichloroethane, nitroalkanes or nitroakenes having from 1 to 6 carbon atoms, such as nitromethane, nitroethane, and the like, benzene, toluene, and mixtures thereof. Mixtures thereof refers to mixtures of the aforementioned and related solvents in all proportions.

Lewis acid compounds useful in forming the soluble pigment-Lewis acid complex are, for example, metal halides such as $AlCl_3$, $GaCl_3$, $FeCl_3$, $InCl_3$, $SnCl_4$, $BF_3$, $ZnCl_2$, $TiCl_4$, $SbCl_3$, $SbCl_5$, $SbF_5$, $CuCl_2$, $VCl_4$, $TaCl_5$, $ZrCl_4$, $AsF_3$, and the like, and mixtures thereof. Mixtures refers for example, to mixtures of the aforementioned and related Lewis acid compounds and related compounds in all proportions. Preferred Lewis acids are, for example, $AlCl_3$ and $FeCl_3$ for ease in handling and lower cost.

Examples of protic solvents include, but are not limited to, water, aliphatic alcohols, such as, methanol, ethanol, propanol, and iso-propanol, acetic acid, n-butyl acetate, formamide, aqueous acetone, acetonitrile, dimethyl formamide, n-methyl-2-pyrrolidinone, and mixtures thereof. In embodiments, the protic solvent may optionally contain other performance enhancing additives such as a surfactant, a pigment dispersant, a colloidal stabilizer, and the like, and mixtures thereof, which additives can be present in amounts of from about 0.01 to about 20 weight percent based on the weight of the pigment. In still other embodiments, the protic solvent can also contain an aqueous base in effective amounts of from about 0.1 to about 10 fold molar excess based on the amount of Lewis acid selected, for the purpose of selectively and efficiently destroying or decomplexing, the pigment-Lewis acid complex, and dissolving residual salts for efficient removal. Suitable bases include, for example, ammonium hydroxide; alkali metal salts of carbonates, acetates, and benzoates; and the like, and mixtures thereof.

The coating of the pigment-Lewis acid complex solution, or the pigment-Lewis acid complex coated colloidal particles, onto a supporting substrate can accomplished in any conventional manner including, for example, casting, spraying, dipping, spin casting, spinning, and the like, methods.

The resulting pigment coated substrate, subsequent to washing and removal of the residual Lewis acid or associated salts, provides a thermal transfer composition which, in embodiments, has pigment particles with an average primary particle size of less than about 100 Angstroms, and preferably, pigment particles with an average primary particle size of less than about 30 Angstroms, for example, from about 15 to about 100 Angstroms, and preferably from about 10 to about 30 Angstroms. The resulting coated pigment composition has a shelf life at ambient temperatures of from about 20° to about 30° C. of in excess of about 2 to about 5 years, and more specifically from about 2 to about 6 years.

The pigment coated substrate compositions are useful in conventional thermal transfer printing processes, thermal wax transfer processes, diffusion thermal transfer processes, and the like processes. Thus, in embodiments, the present invention provides a method of imaging comprising: providing a receiving substrate; providing a thermal diffusion transfer composition comprising a carrier substrate with a nanoscopically dispersed pigment layer coated thereon; and selectively heating the thermal diffusion transfer composition in close proximity, for example, in direct physical contact or physically separated by a distance of about one millimeter or less. to the receiving substrate, wherein the nanoscopically dispersed pigment or pigments contained in the thermal transfer composition transfer to the receiving substrate so that a pigmented image is formed thereon. The heating can be accomplished at from about 50° to about 200° C. for a sufficient time period, for example, from about 0.01 seconds to about 1 minute.

Illustrative examples of binder resin or wax optionally used in conjunction with the pigment nanoparticles, include but are not limited to cellulose ethers and esters, acrylic resins, polyvinyl acetate, polystyrene, and polystyrene-butadiene copolymers, polyesters, polyvinyl butyral, carnauba wax, montan wax, beeswax, ceresine wax, ester wax, oxidized wax, and low molecular weight polyethylenes. The binder or wax can be used, for example, in amounts of from 0.1 to about 100 fold excess by weight of the amount of pigment selected Illustrative examples of receiving substrate, include but are not limited to paper, transparencies, and fabrics.

Illustrative examples the colloidal particles that can be coated by the pigment solution include but are not limited to metallic powders, such as, aluminum, copper, tin or zinc, magnesium or calcium carbonate, metal oxides, cadmium selenide and cadmium sulfide; clay, kaolin, silicic acid anhydride, hydrophobic and hydrophilic fumed silicas, silicones or siloxanes, terpenes, polymeric latex particles, and the like.

Numerous well known suitable pigments can be selected as the colorant for the particles including, for example, carbon black like REGAL 330®, magnetite, or mixtures thereof. The black pigment, which is preferably carbon black, should be present in a sufficient amount to render the thermal transfer composition highly colored. Generally, the pigment particles are present in amounts of from about 1 percent by weight to about 20 percent by weight, and preferably from about 2 to about 10 weight percent based on the total weight of the composition; however, lesser or greater amounts of pigment particles can be selected.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Preparation of Pigment/Aluminum Chloride Solutions

Solubilized pigment/aluminum chloride complex solutions are prepared by stirring a mixture of a pigment, aluminum chloride ($AlCl_3$) and nitromethane or a mixed solvent of nitromethane or methylene chloride as indicated in the Table. The solutions are capped in 20 mL vials in a glove box under nitrogen atmosphere for 12 to 16 hours at room temperature(25° C.). A set of pigment solutions with exemplary compositions is summarized in Table 1. The molar ratio of the pigment to $AlCl_3$ is 1:6 in these Examples. These solutions have about 2 weight percent of pigment and are easily passed through 0.45 micrometer filters.

TABLE 1

| pigments & reagents | soln. 1 | soln. 2 | soln. 3 | soln. 4 | soln. 5 | soln. 6 |
|---|---|---|---|---|---|---|
| TiOPc | 0.26 | — | — | — | — | — |
| VOPc (grams) | — | 0.26 | — | — | — | — |
| PV Fast Blue (grams) | — | — | 0.29 | — | — | — |
| Permanent Yellow (grams) | — | — | — | 0.30 | — | — |
| Hostaperm Pink E (grams) | — | — | — | — | 0.17 | — |
| benzimidazole perylene (grams) | — | — | — | — | — | 0.26 |
| $AlCl_3$ (grams) | 0.39 | 0.39 | 0.39 | 0.39 | 0.39 | 0.39 |
| nitromethane (mL) | 8 | 8 | 10 | 10 | 8 | 8 |
| methylene chloride mL | 2 | 2 | — | — | 2 | 2 |

EXAMPLE II

A polyvinyl butyral coated MYLAR® substrate (6 micron thick and 12×12 inches) is prepared by draw bar coating using a solution of polyvinyl butyral (1.0 gram) in methylene chloride (20 mL). Solution 5 of Table 1 is then draw bar coated onto the precoated MYLAR® substrate. The pigment coated substrate is washed in water for 30 minutes and then air dried or oven dried. The pigment coated MYLAR® substrate is securely taped to one end of a Versatec thermal transfer donor roll. The roll is placed in a Versacolor model C2700 printer. A "XEROX" logo is routed to the printer to give a printed magenta image of "XEROX" on the receiving sheet.

Other modifications of the present invention may occur to one of ordinary skill in the art based upon a review of the present application and these modifications, including equivalents thereof, are intended to be included within the scope of the present invention.

What is claimed is:

1. A process for the preparation of a thermal diffusion transfer component comprising:

dissolving an organic pigment in a Lewis acid and a polar aprotic solvent to form a pigment solution;

coating the solution on a carrier substrate;

optionally washing the coated substrate with a protic solvent to remove the Lewis acid and any residual aprotic solvent; and optionally drying the coated substrate.

2. A process in accordance with claim 1 further comprising adding colloidal particles to the pigment solution, wherein the pigments in the solution associate with the colloidal particles upon coating onto a carrier substrate.

3. A process in accordance with claim 1 wherein the pigment is selected from the group consisting of metal phthalocyanines, metal-free phthalocyanines, oligo metal phthalocyanines, quinacridones, benzimidazole perylenes, perylene tetracarboxyl diimides, substituted 2,4-diaminotriazines, squarines, polynuclear aromatic quinones, thiopyrylium compounds, and mixtures thereof.

4. A process in accordance with claim 1 wherein the pigment concentration in the pigment solution is from about 0.005 to about 50 weight percent.

5. A process in accordance with claim 1 wherein the polar aprotic solvent is selected from the group consisting of methylene chloride, chloroform, trichloroethane, 1,2-dichloroethane, nitroalkanes and nitroakenes with from 1 to about 6 carbon atoms, benzene, toluene, and mixtures thereof.

6. A process in accordance with claim 1 wherein the Lewis acid is a metal halide selected from the group consisting of $AlCl_3$, $GaCl_3$, $FeCl_3$, $InCl_3$, $SnCl_4$, $BF_3$, $ZnCl_2$, $TiCl_4$, $SbCl_3$, $SbCl_5$, $SbF_5$, $CuCl_2$, $VCl_4$, $TaCl_5$, $ZrCl_4$, $AsF_3$, and mixtures thereof.

7. A process in accordance with claim 1 wherein the substrate is selected from the group consisting of paper, organic polymer, wood, metal, woven fabric, non-woven fabric, glass, a thermally conductive metal sheet, and mixtures thereof.

8. A process in accordance with claim 1 further comprising wherein the substrate is precoated with an adhesive layer.

9. A process in accordance with claim 1 wherein the protic solvent is selected from the group consisting of water, methanol, ethanol, propanol, iso-propanol, acetic acid, n-butyl acetate, formamide, aqueous acetone, acetonitrile, dimethyl formamide, n-methyl-2-pyrrolidinone, and mixtures thereof.

10. A process in accordance with claim 1 wherein the protic solvent contains an additive selected from the group consisting of a surfactant, a pigment dispersant, a colloidal stabilizer, and mixtures thereof.

11. A process in accordance with claim 1 wherein the protic solvent contains an aqueous base selected from the group consisting of ammonium hydroxide; alkali metal salts of carbonates, acetates, and benzoates; and mixtures thereof.

12. A process in accordance with claim 1 wherein the coating is accomplished by casting, spraying, dipping, spin casting or spinning.

13. A process in accordance with claim 1 wherein the resulting composition has a shelf life at ambient temperatures of about 20° to about 30° C. of from about 2 to about 5 years.

14. A process in accordance with claim 1 wherein the resulting composition has pigment particles with an average primary particle size of from about 15 to about 100 Angstroms.

15. A process in accordance with claim 1 wherein the resulting composition has pigment particles with an average primary particle size of from about 10 to about 30 Angstroms.

16. A composition in accordance with claim 1, further comprising including a polymer binder or wax in the pigment-Lewis acid solution prior to coating.

* * * * *